United States Patent [19]

Shiou

[11] Patent Number: 4,671,580

[45] Date of Patent: Jun. 9, 1987

[54] KNOCK DOWN FILE CABINET

[75] Inventor: Lin Jun Shiou, Taipei, Taiwan

[73] Assignee: Saga International, Inc., Compton, Calif.

[21] Appl. No.: 789,760

[22] Filed: Oct. 21, 1985

[30] Foreign Application Priority Data

Apr. 2, 1985 [TW] Taiwan ..... 74.4.2

[51] Int. Cl.[4] ..... A47B 43/00

[52] U.S. Cl. ..... 312/257 SM; 312/257 R; 411/84

[58] Field of Search .... 312/257 A, 257 SK, 257 S M, 312/263; 403/21, 22, 406.1; 411/84, 85

[56] References Cited

U.S. PATENT DOCUMENTS

| | | | |
|---|---|---|---|
| 1,714,909 | 5/1929 | Illmer | 312/257 R |
| 2,144,350 | 1/1939 | Swanstrom | 411/84 |
| 2,904,306 | 9/1959 | Gamlen | 403/22 |
| 3,544,185 | 6/1968 | Lundberg | 312/257 R |
| 3,759,600 | 9/1973 | MacDonald | 312/330 |
| 3,784,272 | 1/1974 | Schreiber | 312/245 |
| 3,843,222 | 10/1974 | Berkun | 312/257 |
| 4,003,613 | 1/1977 | Oakley | 312/293 |
| 4,229,921 | 10/1980 | Schell | 52/506 |
| 4,232,920 | 11/1980 | Bukaitz | 312/257 SM |
| 4,270,820 | 6/1981 | McMullan et al. | 312/242 |
| 4,281,883 | 8/1981 | Zacky | 312/140 |
| 4,295,693 | 10/1981 | Viklund | 312/257 |
| 4,447,096 | 5/1984 | Perl et al. | 312/111 |

*Primary Examiner*—Kenneth J. Dorner
*Assistant Examiner*—Joseph Falk
*Attorney, Agent, or Firm*—Fulwider, Patton, Rieber, Lee & Utecht

[57] ABSTRACT

A file cabinet including a pair of opposed side panels, a back panel, front railing and top panel. The side panels are formed at their front and rear extremities with inwardly turned borders which are then turned back on themselves to form joint flanges co-extensive with, but spaced from, the bodies of the respective panels. The back panel is formed on its laterally opposite sides with forwardly turned facing flanges. The top panel is formed on its opposite sides and back side with down turned borders which then turn inwardly to form facing flanges with overlie corresponding joint flanges formed by horizontally inturned portions of the side and back panel. The joint flanges are formed with longitudinally extending raised ribs which nest within recessed grooves formed in the facing flanges to thus provide indexing between the joint and facing flanges. The back sides of the ribs form wells into which are nested fastener nuts which are retained therein and held in alignment with bores formed through the respective flanges such that fastening screws may be easily inserted through such bores and screwed into the respective nuts to thus provide for rapid assembly of the cabinet while leaving the heads of such screws concealed within the confines of the cabinet itself.

6 Claims, 9 Drawing Figures

FIG. 1
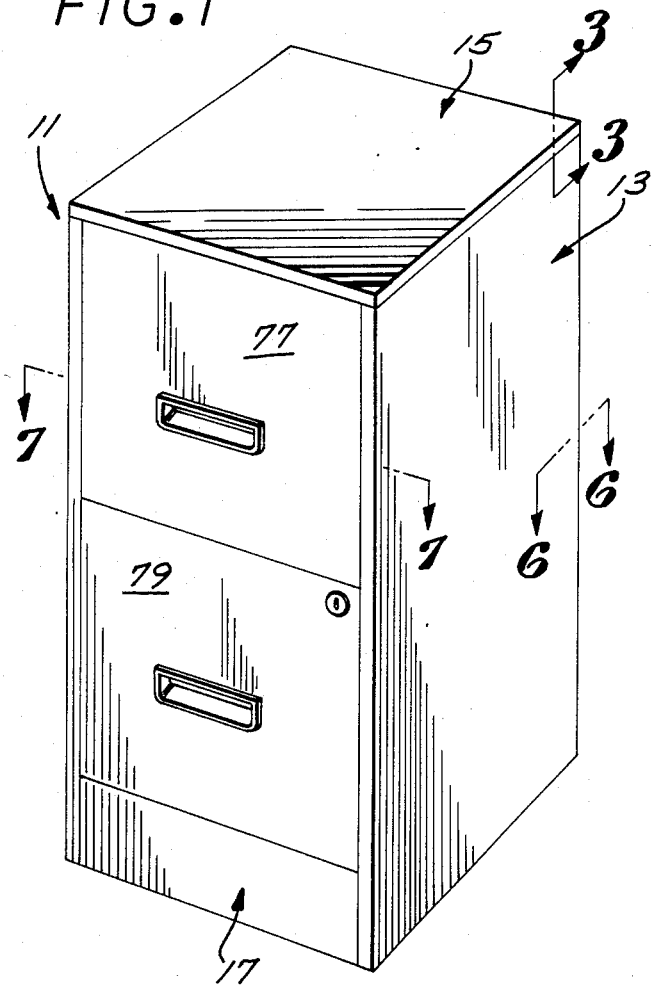
FIG. 2
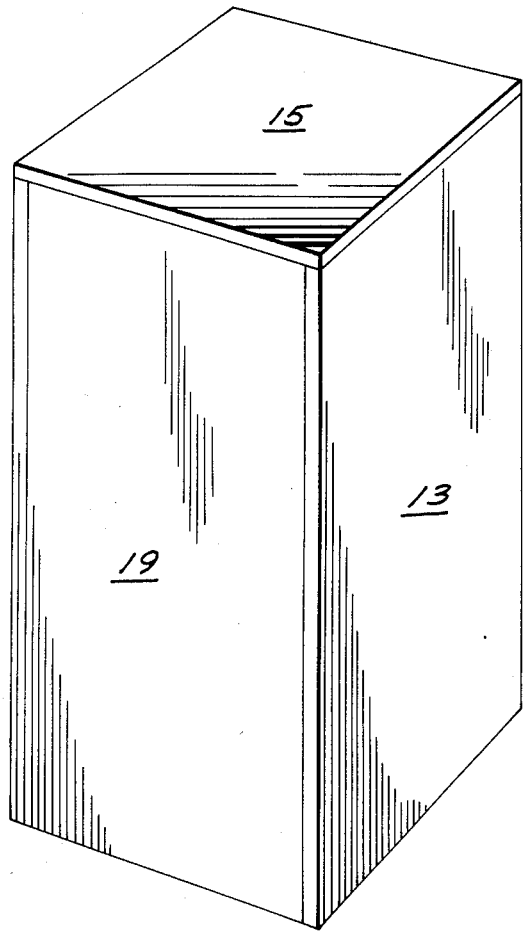
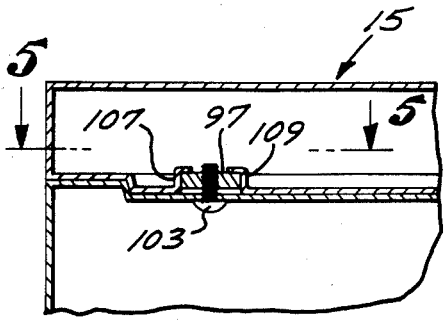
FIG. 4
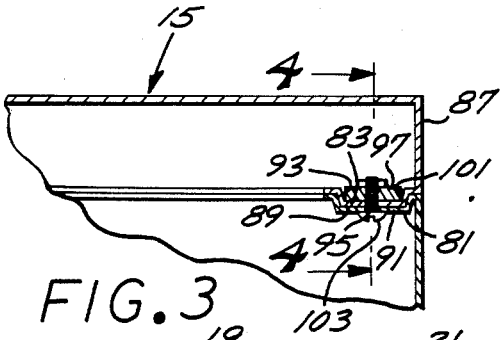
FIG. 3
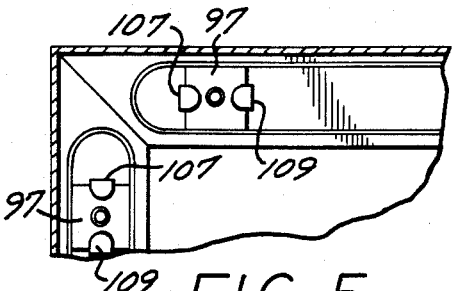
FIG. 5
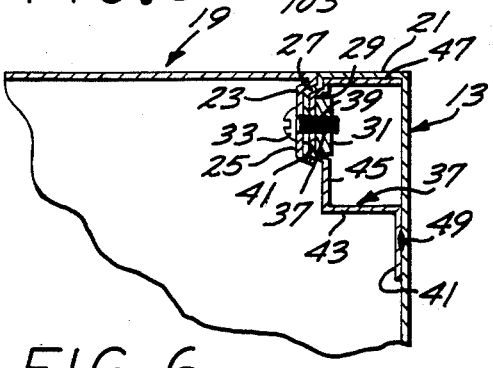
FIG. 6

FIG. 7
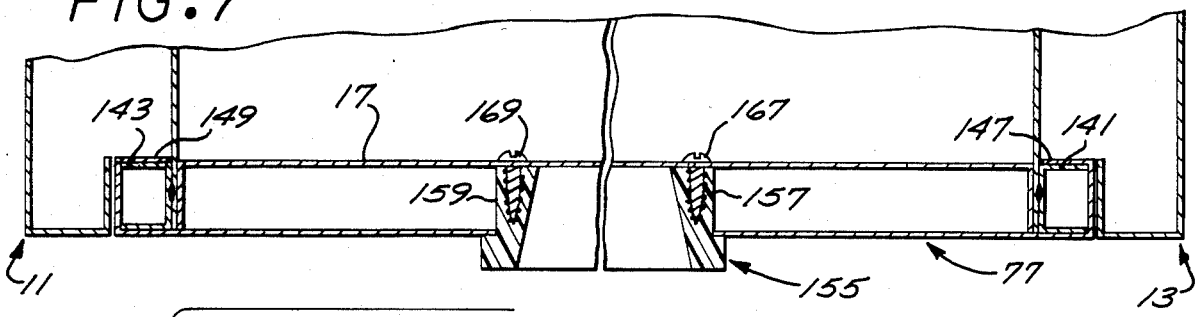
FIG. 8
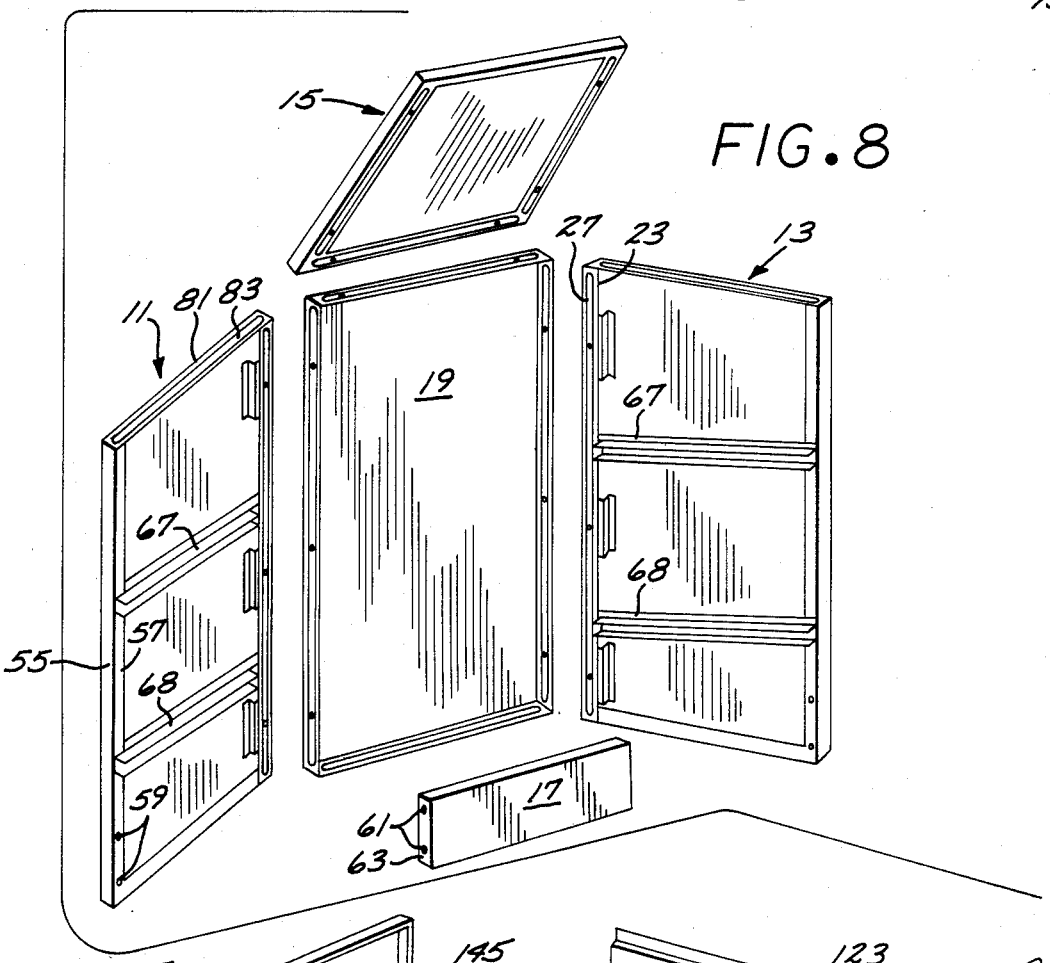
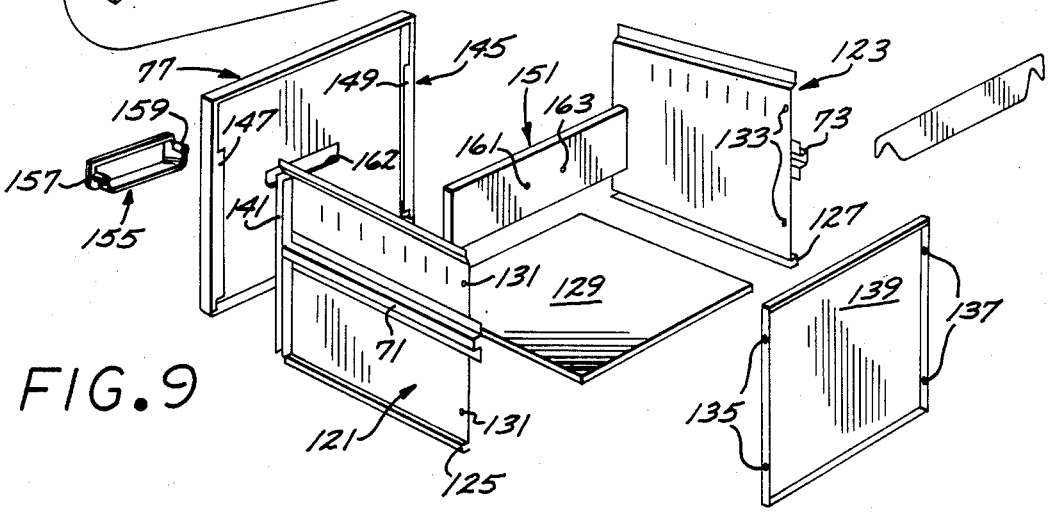
FIG. 9

KNOCK DOWN FILE CABINET

BACKGROUND OF THE INVENTION

1. Field of the Invention

The present invention relates to a knock down filing cabinet which may be conveniently shipped in its knocked down condition and may readily be assembled by a relatively inexperienced user.

2. Description of the Prior Art

One of the prices paid for the increased sophistication of society is the generation of increased volumes of paperwork which must be stored by responsible persons for periodic reference thereto in the conduct of caring for personal and business assets alike. The burden of properly compiling and storing such paperwork for convenient reference thereto is significantly eased by establishing an orderly and convenient filing system. The advantage of a filing system is well recognized in the business world and such advantages have long been known to justify the expense of acquiring and maintaining adequate filing cabinets or shelves. However, many consumers have perceived the expense of acquiring and maintaining file cabinets for storage of personal documents and records as being insufficient to justify the considerable expense of the file cabinet itself.

Consequently, there exists a need for a relatively inexpensive file cabinet which can be made available to the consumer at a relatively inexpensive price so that price of such file cabinets will fall within the price range making them available to consumers of even the most modest means. It has been recognized that file cabinets can be fabricated from sheet metal by mass production techniques at a relatively economical cost. In fact, such manufacturing techniques have rendered such fabrication so economical that the cost of manufacture in many instances may be no greater than the cost of transporting the completed cabinet from the place of manufacture to a remote retail outlet. Accordingly, it is recognized that, if the cost of transportation, which makes up a great portion of the total cost paid by the consumer, could be substantially reduced, the resultant savings to the consumer would be appreciable. Since the intended end use of a file cabinet dictates that the cabinet itself must be of such a character as to define a relatively voluminuous interior, the assembled file cabinet itself must occupy a rather significant volume of space. As a consequence, the transportation costs of shipping a lot of fully assembled file cabinets is driven up by the sheer bulk of the cabinets themselves, rather than merely the combined weight of a lot of such cabinets.

It has long been recognized that a great cost savings would be realized if the component parts of a file cabinets could be stacked in juxtaposition for shipping to the retail outlet for sale and subsequent assembly. Such cabinets so shipped for subsequent assembly by the consumer has become known in the marketplace as knock down or K-D furniture or equipment. Such knock down cabinets, while offering the advantage of reduced transportation costs, have received less than enthusiastic consumer reception because of the perceived, and sometimes justifiably so, difficulties experienced by the average consumer in endeavoring to assemble such knock down cabinets.

The reputation amongst the consuming public of knock down furniture and cabinets has suffered from the fact that such cabinets have included panels manufactured from pressed wood or other relatively soft materials which have proven relatively ineffective in serving to receive and retain the threaded shanks of fastener screws supplied therewith for use in assembling the panels together. Consequently, the consumer has typically been faced with the problem that one or more fastening screws which, when tightened, strip the threads in the panel receiving the shank thereof thus necessitating the consumer being less than satisfied with a cabinet having one or more fasteners missing or requiring him or her to dissassemble the partially assembled cabinet for return to the retailer for a money refund or replacement and a hope of better success in assembling the replacement cabinet. The retailer must then either stand behind the product or incur the ill will generated by a dissatisfied customer, a dilemma which products either a financial burden or loss of a customer and consequent complaints in the marketplace.

Even when the consumer does succeed in overcoming the obstacles of knock down assembly, the prior art cabinets have typically left the heads of the fastening screws exposed thus leaving a relatively unsightly appearance, particularly when relatively inexperienced do-it-yourselfers leave the heads of such screws marred and battered from less than expert manipulation of the screwdriver used during assembly.

Efforts to provide satisfactory knock down cabinets have led to the proposal of panels which incorporate inter fitting tongue and groove arrangements, with or without interlocking angular brackets which slide together during assembly. Interfitting brackets of this type are shown in U.S. Pat. No. 3,784,272 to Schreiber. Such interfitting brackets, while satisfactory for their intended use, suffer the shortcoming that in file cabinets which may carry a relatively heavy load of paper documents, the inter fitting brackets, not providing the tight fit of a screw fastener, will result in a relatively wobbly and insecure final construction which has proven unsatifactory in use.

Efforts to provide knock down assembly has also led to the proposal of corner posts having hinges mounted along one side thereof with one flange of such hinge being adapted for receipt of a screw fastener which may mount a molding formed with a groove for receipt of the marginal edge of an associate panel. Such an arrangement is shown in U.S. Pat. No. 4,281,883 to Zacky. This arrangement, while being satifactory for some display cases and the like, is relatively expensive to fabricate and results in a final construction which does not exhibit the integrity of a cabinet assembled by means of screw fasteners without hinge elements interposes.

Other efforts have led to the proposal of cabinets including corner posts formed with orthogonally opening grooves for receipt of the marginal edges of associated panels. Such an arrangement is shown in U.S. Pat. No. 4,447,096 to Perl. This arrangement, while satisfactory for some modular construction, would require some additional fastening elements in order to provide the necessary rigidity and integrity required for a file cabinet intended to store a heavy load of documents and material.

Appliance cabinets have been proposed which incorporate door panels formed with turned back marginal edges which are then bent perpendicular to the body of the panel to form a flange which is formed with a bore for receipt of a fastener socket. A mating panel is then formed with a perpendicularly turned flange projecting co-extensively with the first mentioned flange and formed with a bore for receipt therethrough of a shank of a fastener which is inserted in the socket to leave the fastener head exposed to the rear. An appliance cabinet of this type is shown in U.S. Pat. No. 4,229,921 to Schell. However, such an arrangement, while being satisfactory for the doors of dishwasher cabinets and the like, would be unsatisfactory for file cabinets of the present invention where the cabinet is typically exposed on four sides thus making it desirable that the head of the fastener be concealed within the confines within the cabinet itself.

It has been proposed that appliance cabinets incorporate fastener nuts held non-rotationally in position for receipt of a fastener screw inserted through a mating panel. Such an arrangement is shown in U.S. Pat. No. 4,003,613. While satisfactory for applications where the head of the screw is to be exposed, such an arrangement would not be satisfactory for the file cabinet of the present invention where it is desirable to conceal the screw head.

Other objects and features of the invention will become aparent from consideration of the following description taken in connection with the accompany drawings.

BRIEF DESCRIPTION OF THE DRAWINGS

FIG. 1 is a front three-quarter perspective view of a knock down file cabinet embodying the present invention;

FIG 2 is a rear three-quarter perspective view of the knock down file cabinet shown in FIG. 1;

FIG. 3 is a vertical sectional view, in enlarged scale, taken along the line 3—3 of FIG. 1;

FIG 4 is a vertical sectional view taken along the line 4—4 of FIG. 3;

FIG. 5 is a horizontal sectional view taken along the line 5—5 of FIG. 4;

FIG. 6 is a horizontal sectional view, in enlarged scale, taken along the line 6—6 of FIG. 1;

FIG. 7 is a horizontal broken sectional view, in enlarged scale, taken along the line 7—7 of FIG. 1;

FIG. 8 is an exploded view, in reduced scale, of the file cabinet shown in FIG. 1; and FIG. 9 is an exploded perspective view of a drawer included in the file cabinet shown in FIG. 1.

DESCRIPTION OF THE PREFERRED EMBODIMENT

Referring to FIG. 1, the knock down file cabinet of the present invention includes a housing structed generally of opposed side panels 11 and 13, a top panel 15, front rail 17, and back panel 19. Referring to FIGS. 6 and 8, the side panels 11 and 13 are of similar construction, the panel 13 being formed at its rear extremity with an inturned vertical border 21 which is then turned back on itself to form a joining flange 23 spaced from the body of the panel to form a channel shape. The back panel 19 is formed at its opposite sides with forwardly turned vertical facing flanges 25 respectfully, which overlie the joining flanges 23. The panels 13 and 19 are preferably constructed of metal and the joining flange 21 is preferably formed with a longitudinal raised rib 27 which forms therebehind an elongated well 29 which receives a plurality of longitudinally spaced apart fastening nuts 31 which are held non-rotatably in position for receipt of respective fastening screws 33. Consequently, the flanges 23 and 25 may conveniently be fitted together by the consumer with the screws 33 inserted to hold them firmly in position to afford rigid construction while concealing the head of the screw 33 within the confines of the cabinet itself.

The cabinet of the present invention, in the preferred embodiment, is constructed entirely of sheet metal and is configured to afford, in its assembled condition, a clean overall appearance without evidence of exposed fastener heads. The sheet metal side panels 11 and 13 are preferably formed by bending the top bottom and front and rear marginal edges inwardly to provide post-like reinforcement and also afford the benefit of the fastening joints described hereinafter. The panel 13 shown in detail in FIG. 6 is bent inwardly at its rear extremity to form the border 21 and is then again bent forwardly in channel fashion to form the joining flange 23. It will be noted that the rib 27 is pressed laterally inwardly out of the body of the flange 23 and that such rib extends longitudinally over substantially the entire height of the panel (FIG. 8).

The rib 27 is formed of a width sufficient to form the well 29 on the back side thereof of a width corresponding with the distance between the opposite faces of the fastening nuts 31 such that the nuts 31 when nested in such well are retained against rotation under influence of the screw 33. The nuts 31 are held captive in the well 29 by a method to be described hereinafter to be maintained in alignment with bores 37 formed in the respective flanges 23 to be registered with corresponding apertures 39 formed in the respective facing flanges 37 during assembly. It will be noted from FIG. 8 that there are three sets of such bores and apertures for each joint formed between the respective side walls 11 and 13 and back panel 19.

With continued reference to FIG. 6, it is noted that the facing flange 25 formed at the marginal edge of the back panel 19 turns generally forwardly but then has a groove 41 pressed therein which mates with the rib 27 pressed out of the joining flange 23. The cross section of such rib and groove are complementally shaped for nesting thereof together to achieve indexing of the side panels 11 and 13 with respect to the back panel 19 during assembly.

With continued reference to FIGS. 6 and 8, a post bracket 37 is interposed between the joining flange 23 and the body of the respective side panels 11 and 13 at the location of each bore 37 to reinforce the joining flange 23 and cooperate in forming the well 29. The post brackets 37 are of generally C-shaped construction each being formed with a base leg 41 inwardly turned leg 43, rearwardly turned leg 45 into which is formed the well 29 and then outwardly turned leg 47. It will be appreciated that the legs 43, 45 and 47 cooperate to form a C-shaped channel member configured to be close fit between the joining flange 23 and the body of the panel 41. The base leg 41 is tack welded to the body of the panel 13 at 49.

Referring to FIG. 8, the front extremities of the side panels 11 and 13 are turned inwardly to form front borders 55 and then are turned back on themselves to form respective joining flanges 57. Bores 59 are formed at the bottom of such joining flanges 57 for receipt of fasteners inserted through apertures 61 formed in the rearwardly turned facing flanges 63 of the front rail 17. A pair of inwardly opening horizontally extending channel members 67 and 68 are mounted in opposed relationship on the interior of the panels 11 and 13 and slope rearwardly and slightly downwardly to act as tracks for receipt of riders 71 and 73 mounted on the opposite sides of drawers, generally designated 77 and 79 (FIGS. 1 and 9).

The top extremity of the side panels 11 and 18 are bent inwardly to form horizontal facing flanges 81 (FIGS. 3 and 8) which are formed with downwardly pressed longidutinal grooves 83. The top panel 15 is formed on its marginal edges with down turned borders 87, the laterally opposite borders and rear border being turned inwardly to form respective joining flanges 89 which are formed with pressed out ribs 91 that are complementally received in the grooves 83 and form on the top sides thereof depressed wells 93. The joining flanges 89 and facing flanges 81 are formed with longitudinally spaced apart bores 95 and apertures 97, the apertures 97 having mounted therebehind respective fastener nuts 101 for receipt of the threaded shanks of fastening screws 103.

Referring to FIG. 4, the ribs 91 of the joining flanges 89 are formed adjacent the respective apertures 97 with pressed out ears 107 and 109 which are turned inwardly to clip over the opposite edges of the respective fastener nuts 97 to hold such fastener nuts captive within the respective wells 93. It will be appreciated that in the preferred embodiment, the ribs formed in the respective flanges 23 of the side panels 11 and 13 (FIG. 6) are similarly constructed to retain the respective fastener nuts 31 in position.

Referring to FIG. 9, the drawers 77 and 79 are formed with oppositely disposed side walls, generally designed 121 and 123, having riders 71 and 73 mounted centrally on the outsides thereof. The side walls 121 and 123 are formed in their lower extremities with respective inwardly opening channels 125 and 127 for receipt of the opposite marginal edges of a bottom panel 129. Formed along the back marginal edges of the side walls 121 and 123 are fastening bores 131 and 133 for receipt of fastening screws (not shown) which are received in respective bores 135 and 137 formed in the opposite turned back flanges of a rear wall generally designed 139. Mounted on the outside of the front edges of the side walls 121 and 123 are outwardly opening spacer channels 141 and 143, respectively (FIG. 7). A front wall, generally designated 145, is formed along its opposite sides with turned back marginal edges which are turned laterally inwardly to form respective retaining flanges 147 and 149 which are spaced back of the body of the front wall 145 a distance sufficient to complementally receive between such flanges and such body the spacer channels 141 and 143 mounted on the front edges of the side panels 121 and 123 (FIG. 7).

Still referring to FIG. 9, mounted intermediately behind the front wall 145 is a spacer panel, generally designated 151, which is formed at its periphery with forwardly turned marginal edges. The spacer panel 151 is of a length sufficient to closely fit between the bodies of the side walls 121 and 123 in close spaced relationship as shown in FIG. 7 to hold the spacer channels 141 and 143 captive in front of the inturned flanges 147 and 149 of the front wall 77.

In the preferred embodiment, the front wall 145 is formed centrally with a rectangular aperture 162 for receipt thereinto of the body of a rectangular handle, generally designed 155. The handle 155 is formed on its opposite ends with fastener bosses 157 and 159 which align with bores 161 and 163 formed in the spacer 155 such that fastening screws 167 and 169 (FIG. 7) may be received through such bores 161 and 163 and into the lugs 157 and 159.

From the foregoing it will be apparent that the panel components 11, 13, 15, 19 and rail 17, and components of the drawers 77 and 79 may conveniently be formed by bending and pressing sheet metal by well known mass production techniques. The resulting components may then be tack welded as required, painted and stacked together in a relatively compact package thus enabling a relatively significant number of such components to be transported in a container or transport truck. It will be appreciated that the mating grooves and ribs may be pressed from their respective flanges and the holding tabs 107 and 109 pressed from the body of the respective ribs to hold the respective fastening nuts captive in position. Consequently, other than for the fastening screws, there are no loose or disassociated fastening elements which may become lost during transport or misplaced during unpackaging of the components themselves thus eliminating a well known irritant frequently experienced by more do-it-yourselfers.

The consumer may then purchase and transport home a relatively compact package containing all the components for the file drawer of the present invention. It will be apparent that any instructional sheet for assembly will be relatively short, simple and straightforward. The panel components may be assembled together in a relatively logical manner with the interfitting grooves and ribs indexing the panels in position and holding them in place while the user inserts the fastening screws. The fastening screws may be conveniently inserted and screwed into the fastening nuts to a finger tight condition and then tightened to a final secure condition by a common screwdriver. Once the back panel 19, side panels 11 and 13 and top panel 15 have been assembled and the front rail 17 secured in position, the drawers 77 and 79 may conveniently be assembled together.

This procedure merely involves sliding the front channels 141 and 143 of the side walls 121 and 123 (FIGS. 7 and 9) in front of the retaining flanges 147 and 149 of the front wall 145 with the opposite marginal edges of the bottom wall 129 held within the channels 125 and 127 (FIG. 9). The back wall 139 may then be moved into position between the sides 121 and 123 and the fasteners (not shown) inserted. The side walls 121 and 123 are then securely held captive to the front wall 145 and the handle 155 secured in position by inserting the screws 167 and 169 (FIG. 7) to hold the spacer 151 in place and the handle 155 secured to the front of the drawer.

From the foregoing it will be apparent that applicant has provided a knock down file cabinet which is economical to manufacture and which may be rapidly and conveniently assembled by the user without experiencing the well known irritations heretofore accompanying assembly of knock down cabinets. The resultant cabinet provides for concealment of the heads of the fastener used in assembly to thereby leave a clean well finished appearance and while affording a secure and rigid construction.

Various modifications and changes may be made with regard to the foregoing detailed description without departing from the spirit of the invention.

I claim:

1. A knock down metal file cabinet comprising:

a pair of oppositely disposed metal side panels spaced a predetermined distance apart and formed with respective planar walls preformed at their respective rear extremities with inturned borders which project perpendicularly inwardly from said walls and then turn to project forwardly to form respective joint flange means, said joint flange means including preformed fastener-receiving bores spaced vertically therealong;

a back panel including a wall spanning between said side panels and formed at its laterally opposite sides with forwardly projecting facing flanges configured to overlie said joint flange means, said facing flanges including preformed apertures aligned with said preformed bores;

a top panel having peripheral margins overlying the top ends of said side and back panels:

a front rail projecting between said joint flange means of said side panels;

removable fastening means for removably fastening said top panel to said side panels and the opposite ends of said front rail to said joint flange means;

fastener nuts disposed on the side of said respective joint flange means facing said respective walls to be concealed by said respective walls from view from the exterior of said cabinet and further being disposed in alignment with said respective bores;

means affixing said fastener nuts to said joint flange means to hold said fastener nuts in position and restraining them from rotation;

fastener screws for selective insertion in said respective apertures and through said respective bores for threadable engagement with said fastener nuts, thereby said back and side panels may be erected with said facing flanges overlying said respective flange means and said fastener screws inserted through said respective apertures, through said bores and screwed into said respective nuts to secure said side panels to said back panel with said back and side panels cooperating to conceal said nuts and screws from view from the exterior side of said panel, said front rails may be positioned between said joint flange means; said top panel positioned over the top ends of said back and side panels and said removable fastener means inserted to secure said front rail and top panel in place.

2. A knock down metal file cabinet according to claim 1 wherein:

said side panels include channel shaped reinforcing brackets configured and dimensioned to be interposed in close fitting relationshp between said joining flange means and said walls of said side panels and means affixing said brackets to said side panels.

3. A knock down metal file cabinet according to claim 1 which includes:

track means mounted in confronting relationship on said side panels;

at least one drawer assembly for fitting between said panels for slidable engagement with said track means, said drawer including a pair of opposed side walls, a back wall, front wall and bottom wall, said front wall being formed at its opposite lateral extremities with rearwardly turned borders which are turned back on themselves to form respective return flanges spaced a predetermined distance from the body of said front wall to cooperate therewith in forming respective retaining channels and spacers mounted on the laterally outer sides of the front ends of said side walls, said spacers being of substantially said predetermined width for nesting in said locking channels.

4. A knock down metal file cabinet according to claim 1 wherein:

said joining flange means includes planar flanges formed with elongated indexing ribs raised in the direction of said facing flanges; and said facing flanges are formed with elongated indexing grooves configured to complementally receive and mate with said ribs to register said back panel with respect to said side panels.

5. A knock down metal file cabinet according to claim 1 wherein:

said side and back panels are formed at their top extremities with inturned peripheral top flanges, said peripheral flanges including top bores spaced therealong; and said top panel is formed on its laterally opposite sides with respective downwardly turned borders, which project downwardly are then turned inwardly to form respective horizontal top joining flanges, overlying said peripheral top flanges and including spaced apart top apertures aligned with said top bores;

threaded nuts on the tops of said top joining flanges and aligned with said top bores;

means affixing said nuts to said top forming flange; and screws insertable through said respective top bores and top apertures and screwable into said respective nuts to affix said top flanges together.

6. A knock down metal file cabinet according to claim 1 wherein:

said respective joining flange means includes planar flanges formed centrally with ribs pressed inwardly toward one another to form on the outside of said joining flange means, longitudinal wells having side walls spaced apart a predetermined distance, said bores being aligned along the longitudinal center of said wells; and said fastener nuts being in the form of conventional threaded polygonal nuts configured with oppositely facing faces spaced apart said predetermined distance and each being received in said respective wells in alignment with said respective bores.

* * * * *